US011230081B2

(12) United States Patent
Huber et al.

(10) Patent No.: US 11,230,081 B2
(45) Date of Patent: Jan. 25, 2022

(54) CORRUGATED BOARD PLANT

(71) Applicant: BHS Corrugated Maschinen- und Anlagenbau GmbH, Weiherhammer (DE)

(72) Inventors: Guenter Huber, Stulln (DE); Lars Engel, Schirmitz (DE); Alfons Gnan, Vilseck (DE)

(73) Assignee: BHS Corrugated Maschinen- und Anlagenbau GmbH, Weiherhammer (DE)

( * ) Notice: Subject to any disclaimer, the term of this patent is extended or adjusted under 35 U.S.C. 154(b) by 0 days.

(21) Appl. No.: 16/459,042

(22) Filed: Jul. 1, 2019

(65) Prior Publication Data

US 2020/0009821 A1 Jan. 9, 2020

(30) Foreign Application Priority Data

Jul. 5, 2018 (DE) ..... 10 2018 211 141.3

(51) Int. Cl.
*B31F 1/28* (2006.01)
*B26D 1/62* (2006.01)
*B65H 33/04* (2006.01)

(52) U.S. Cl.
CPC ..... *B31F 1/2804* (2013.01); *B26D 1/626* (2013.01); *B31F 1/2822* (2013.01); *B65H 33/04* (2013.01); *Y10T 156/1057* (2015.01)

(58) Field of Classification Search
CPC ..... B31F 1/2804; B31F 1/2822; B26D 1/626; B65H 33/04; Y10T 156/1057
See application file for complete search history.

(56) References Cited

U.S. PATENT DOCUMENTS 3,375,744 A * 4/1968 Schieven ..... B65H 33/04 83/23
5,346,195 A 9/1994 Heimann et al.
5,492,315 A * 2/1996 Maruyama ..... B42C 1/00 270/58.32
5,575,463 A 11/1996 Parkander
5,632,850 A 5/1997 Knorr et al.
(Continued)

FOREIGN PATENT DOCUMENTS

DE 195 20 077 A1 1/1996
DE 695 06 756 T2 2/1999
(Continued)

*Primary Examiner* — Mark A Osele
*Assistant Examiner* — Christopher C Caillouet
(74) *Attorney, Agent, or Firm* — McGlew and Tuttle, P.C.

(57) ABSTRACT

A corrugated board plant includes a corrugated board production assembly for producing a double-face laminated web of corrugated board, and at least one cutting assembly arranged downstream of the corrugated board production assembly, which has a cross-cutting device for producing sheets from the double-face web of corrugated board, and is capable of producing at least one identification sheet from the double-face laminated web of corrugated board, which is different from the sheets. The corrugated board plant further has a stack depositing area arranged downstream of the cutting assembly to stack the sheets and the at least one identification sheet in such a way as to form a stack, which is identifiable by means of the at least one identification sheet, in particular for further processing.

17 Claims, 9 Drawing Sheets

(56) References Cited

U.S. PATENT DOCUMENTS

| | | | | |
|---|---|---|---|---|
| 7,011,005 | B2 * | 3/2006 | Koutonen | B26D 7/2635 83/34 |
| 2004/0182503 | A1 * | 9/2004 | Stadele | B31F 1/2813 156/210 |
| 2018/0345619 | A1 * | 12/2018 | Lang | B31F 1/2818 |
| 2019/0084266 | A1 | 3/2019 | Grünwald et al. | |

FOREIGN PATENT DOCUMENTS

| | | | |
|---|---|---|---|
| DE | 10 2004 003 560 | A1 | 8/2005 |
| DE | 10 2016 206 016 | A1 | 10/2017 |
| EP | 0 687 552 | A2 | 12/1995 |
| EP | 1 459 878 | A2 | 9/2004 |

* cited by examiner

CORRUGATED BOARD PLANT

CROSS-REFERENCE TO RELATED APPLICATIONS

This application claims the priority of German Patent Application Serial No. DE 10 2018 211 141.3, filed on Jul. 5, 2018, pursuant to 35 U.S.C. 119(a)-(d), the content of which is incorporated herein by reference in its entirety as if fully set forth herein.

FIELD OF THE INVENTION

The invention relates to a corrugated board plant for producing corrugated board. The invention further relates to a method for producing corrugated board.

BACKGROUND OF THE INVENTION

Corrugated board plants are generally known from prior art. It is common practice to stack the corrugated board thus produced in the form of sheets. The sheets arranged in a stack are generally identical. However, the sheets arranged in the different stacks frequently differ from each other. It is known through prior public use to insert an identification sheet into each stack by hand, which allows the respective stack or its assignment to a particular order to be identified easily.

SUMMARY OF THE INVENTION

The invention is based on the object of providing a corrugated board plant, which is particularly functionally safe and efficient. Another object is to provide a corresponding method for producing corrugated board.

According to the invention, this object is achieved by a corrugated board plant, comprising a corrugated board production assembly for producing a double-face laminated web of corrugated board, at least one cutting assembly arranged downstream of the corrugated board production assembly, which has a cross-cutting device for producing sheets from the double-face web of corrugated board and is capable of producing at least one identification sheet from the double-face laminated web of corrugated board, which is different from the sheets, and a stack depositing area arranged downstream of the cutting assembly for stacking the stacks and the at least one identification sheet in such a way as to form a stack, which is identifiable by means of the at least one identification sheet, in particular for further processing.

According to another aspect of the invention, this object is achieved by a method for producing corrugated board, comprising the steps of producing a double-face laminated web of corrugated board in a corrugated board production assembly, producing stacks from the double-face laminated web of corrugated board by means of a cross-cutting device of a cutting assembly, producing at least one identification sheet from the double-face laminated web of corrugated board by means of the cutting assembly, the at least one identification sheet differing from the sheets, and stacking the sheets and the at least one identification sheet in a stack depositing area in such a way as to form a stack, which is identifiable by means of the at least one identification sheet, in particular for further processing.

The key element of the invention is in particular a cutting assembly, which is capable of creating (order) sheets according to order, in particular for further processing, on the one hand, and at least one identification sheet on the other, which is inserted into the respective stack to allow it to be identified easily or to mark it in such a way as to be identified easily. The at least one identification sheet is producible and insertable into the respective stack automatically or autonomously by means of the cutting assembly. This allows an operator, for example, to identify the stacks produced by means of the at least one identification sheet, which is characteristic for this stack, for further transport, a production of a cardboard box or the like.

Except for the at least one identification sheet disposed therein, the sheets arranged in one stack are preferably identical. Advantageously, they are arranged on top of each other in the respective stack.

The finished double-face laminated web of corrugated board preferably comprises at least one inner corrugated web and an outer smooth cover web and a laminating web. The double-face laminated web of corrugated board comprises a total of three layers, five layers or seven layers, for example. It is preferably endless.

The double-face laminated web of corrugated board is cut to desired sizes by means of the cutting assembly.

Advantageously, the cross-cutting device is capable of separating the entire double-face laminated web of corrugated board across its entire width. It is associated to the double-face laminated web of corrugated board.

For example, the cross-cutting device is configured as a short cross-cutting device, which is otherwise used in particular in the event of an order change.

Advantageously, the cutting assembly is in signal connection with a control unit, said signal connection preferably being wireless or wired. It allows a transmission of signals. The control unit is preferably electronic. It emits signals to the respective unit(s).

The expressions "upstream", "downstream", "arranged in front of" and "arranged behind" used in this disclosure refer in particular to a transport direction of the respective web or of the sheets.

It is expedient if the cross-cutting device as claimed in sub-claim 2 is in signal connection with the, in particular central, control unit and is actuated accordingly by the latter to create the at least one identification sheet. The at least one cross-cutting member of the cross-cutting device, which is actuable accordingly to produce the at least one identification sheet, is preferably configured as a cross-cutting roller. To produce the at least one identification sheet, the at least one cross-cutting member is for example operated preferably at a different cut length than that used for the production of the sheets. When the at least one cross-cutting member is actuated at a later point in time to produce the at least one identification sheet than to produce the sheets, an identification sheet is produced, which is longer than the sheets and can thus be identified. When the at least one cross-cutting member is actuated at an earlier point in time to produce the at least one identification sheet than to produce the sheets, an identification sheet is produced, which is shorter than the sheets and can thus be identified.

Advantageously, the longitudinal cutting/grooving device, which is capable of producing the at least one identification sheet and preferably has at least one cutting knife, which is actuable accordingly to produce the at least one identification sheet, is in signal connection with the control unit. The longitudinal cutting/grooving device in particular performs the task of longitudinally cutting the transported double-face laminated web of corrugated board and of grooving it in such a way as to comply with cardboard box cutouts to be produced.

The longitudinal cutting/grooving device advantageously comprises at least one longitudinal cutting unit, which is preferably adjustable in a width direction/transverse direction of the double-face laminated web of corrugated board, and is preferably capable of cutting the double-face laminated web of corrugated board into partial webs at a distance from its longitudinal edge.

The longitudinal cutting/grooving device preferably has two grooving units arranged one behind the other in a transport direction of the double-face laminated web of corrugated board. It is advantageous if each grooving unit has a grooving tool and a counterpart grooving tool interacting therewith during use.

It is expedient if the at least one cutting knife, which is actuable accordingly to produce the at least one identification sheet, is in the shape of a circular disc and is drivable for rotation.

The at least one cutting knife of the longitudinal cutting/grooving device, which moves laterally in a transverse direction of the identification sheet while the at least one identification sheet is being produced, is displaceable in a transverse direction of the double-face laminated web of corrugated board. For example, it is displaceable relative to the double-face web of corrugated board in a laterally outward direction, thus forming at least one identification lug, or in a laterally inward direction, thus forming at least one identification recess.

The at least one cutting knife of the longitudinal cutting/grooving device, which changes its engagement depth with the double-face laminated web of corrugated board while the at least one identification sheet is being produced, is displaceable preferably vertically. It is in particular capable of engaging the double-face laminated web of corrugated board at various depths, which—on account of the circular design of the cutting knife—causes cuts with different lengths to be produced in the double-face laminated web of corrugated board. This again provides a simple manner of producing at least one identification recess and/or identification lug in the at least one identification sheet.

The at least one edge knife of the longitudinal cutting/grooving device is in particular capable of cutting or separating edge strips from the double-face laminated web of corrugated board. The at least one longitudinal cutting knife is in particular capable of producing partial webs from the double-face laminated web of corrugated board, which are therefore identical in design, by means of at least one longitudinal cut.

The at least one identification sheet configured such that it is visible from outside in the stack, in particular laterally from outside, in particular by an operator, allows the entire stack to be identified easily. The at least one identification sheet may for example be disposed at the very bottom or at the very top or in-between in the stack.

The at least one identification sheet differs from the sheets in particular in terms of its design, in other words its shape or geometry, which allows it to be identified easily.

The at least one identification sheet is for example shorter or longer than the sheets in the stack.

The at least one identification sheet is for example wider or narrower than the sheets in the stack.

For example, it has straight longitudinal edges and/or transverse edges. Alternatively, it has a non-uniform length and/or width. The at least one identification sheet is for example symmetric or non-symmetric.

A preferred embodiment of the invention will hereinafter be described by way of example, taken in conjunction with the enclosed drawing.

DESCRIPTION OF THE PREFERRED EMBODIMENT

Figure 1:
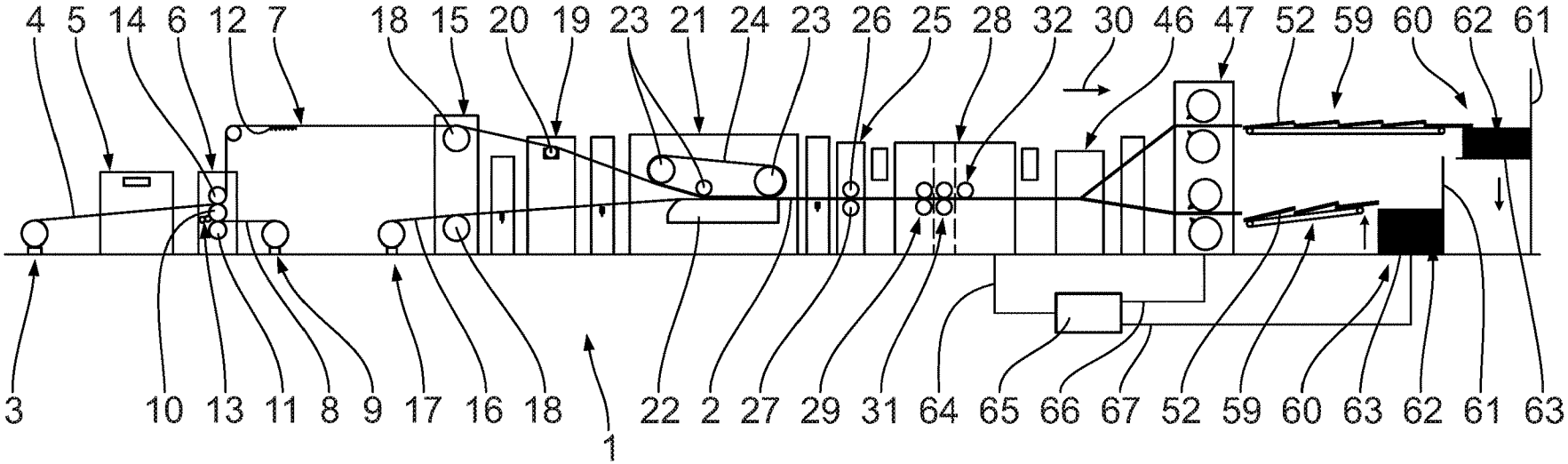
FIG. 1 shows a simplified view of a corrugated board plant according to the invention.

A corrugated board plant as shown as a whole in the simplified view according to FIG. 1 comprises a corrugated board production assembly 1 for producing a double-face laminated web 2 of corrugated board.

The corrugated board production assembly 1 comprises a first unwinding device to unwind a cover web 4. Advantageously, the first unwinding device 3 is configured as a splicer so the cover web 4 is endless.

The cover web 4 is fed, via a heating device 5, to a corrugated board production device 6 for producing a single-face laminated web of corrugated board. The corrugated board production device 6 is part of the corrugated board production assembly 1. In the corrugated board production device 6, the cover web 4 is combined with an intermediate web 8 fed by a second unwinding device 9. The second unwinding device 9 is preferably configured as a splicer so the intermediate web 8 is endless.

In the corrugated board production device 6, the intermediate web 8 is passed through between two corrugating rollers 10, 11 arranged adjacent to one another, causing the intermediate web 8 to be provided with corrugations or flutes in such a way as to be available as a corrugated web 12 after passing through the corrugating rollers 10, 11. In the corrugated board production device 6, glue is applied to tips of the corrugated web 12 by means of a gluing device 13. The gluing device 13 has a gluing roller, which forms a glue gap with the corrugating roller 10 shown at the top in this example.

In the corrugated board production device 6, the corrugated web 12 provided with glue in the gluing device 13 is then pressed together with the cover web 4 in a pressure gap between a pressing device 14 and the upper corrugating roller 10 such that an adhesive bond is formed therebetween. The pressing device 14 is configured as a pressing roller in this example. Alternatively, said pressing device 14 comprises at least two deflection rollers and a pressing belt guided around said deflection rollers, the pressing belt forming the pressure gap with the upper corrugating roller 10.

The single-face laminated web of corrugated board 7, which is preferably endless and includes the cover web 4 and the corrugated web 12 or the intermediate web 8, is guided out of the corrugated board production device 6. The corrugated board production device 6 is known from EP 0 687 552 A2 or U.S. Pat. No. 5,632,850, for example, to which reference is made for further details.

The single-face laminated web of corrugated board 7 is fed to a pre-heating device 15 of the corrugated board production assembly 1. A laminating web 16 is also fed to the pre-heating device 15 from a third unwinding device 17. The third unwinding device 17 is preferably configured as a splicer so the laminating web 16 is endless. The pre-heating device 15 has two heatable heating rollers 18 arranged one above the other. The single-face web of corrugated board 7 and the laminating web 16 surround the respective heating roller 18 in the pre-heating device 15 partly and are heated there.

Downstream of the pre-heating device 15, the corrugated board production assembly 1 comprises a gluing unit 19 with a gluing roller 20, which partly immerses into a glue bath. The corrugated web 12 of the single-face web of corrugated board 7 is in contact with the gluing roller 20 such that glue is applied to the corrugated web 12 there.

Downstream of the gluing unit 19, the corrugated board production assembly 1 has a heating and pressing device 21 with a horizontal table 22, which comprises heating plates. Above the table 22, the heating and pressing device 21 has an endless, driven pressing belt 24, which is guided around rollers 23. Between the pressing belt 24 and the table 22, a pressure gap is formed through which the single-face laminated web of corrugated board 7 and the laminating web 16 are guided so as to be pressed together, which causes an adhesive bond to be formed between them. In the heating and pressing device 21, the double-face laminated web 2 of corrugated board is formed.

Downstream of the heating and pressing device 21, the corrugated board plant has a short cross-cutting device 25. The short cross-cutting device 25 comprises a knife cylinder 26 and a counterpart cylinder 27 arranged therebelow. The knife cylinder 26 and the counterpart cylinder 27 are mounted such as to be drivable for rotation.

The knife cylinder 26 has a cylinder jacket on which a knife with a cutting edge is mounted. The counterpart cylinder 27 also has a cylinder jacket on which a knife with a cutting edge is mounted. Furthermore, a row of counterpart members is arranged on the cylinder jacket of the counterpart cylinder 27, the counterpart members being displaceable between two radially protruding stops mounted on the cylinder jacket in such a way as to extend across the width of the counter cylinder 27.

The short cross-cutting device 25 is capable of producing a cut, which extends across the entire width of the double-face laminated web 2 of corrugated board. To this end, the knife cylinder 26 and the counterpart cylinder 27 are driven for rotation in such a way as to interact with one another during the cutting process. The short cross-cutting device is further capable of producing a cut with a particular length and distance from a longitudinal edge of the double-face laminated web 2 of corrugated board. To this end, the counterpart members are selected or displaced accordingly. To perform the cutting process, the knife cylinder 26 and the counterpart cylinder 27 are driven for rotation in such a way that the knife of the knife cylinder 26 interacts with the counterpart members.

Further details concerning the design of the short cross-cutting device 25 and its function can be found in DE 10 2004 003 560 A1.

Figure 2:
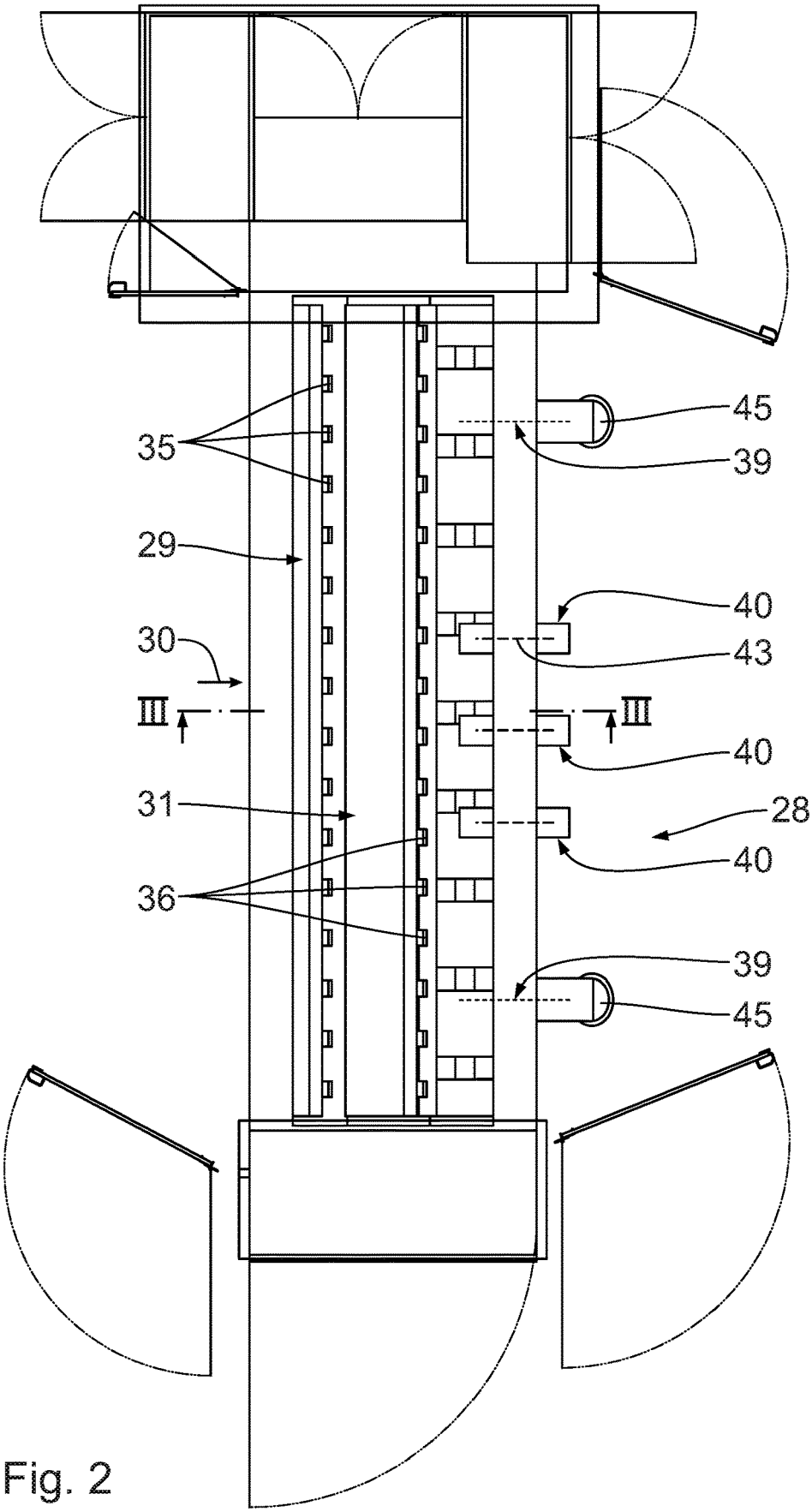
FIG. 2 shows a plan view of a longitudinal cutting/grooving device of the corrugated board plant shown in FIG. 1.
Figure 3:
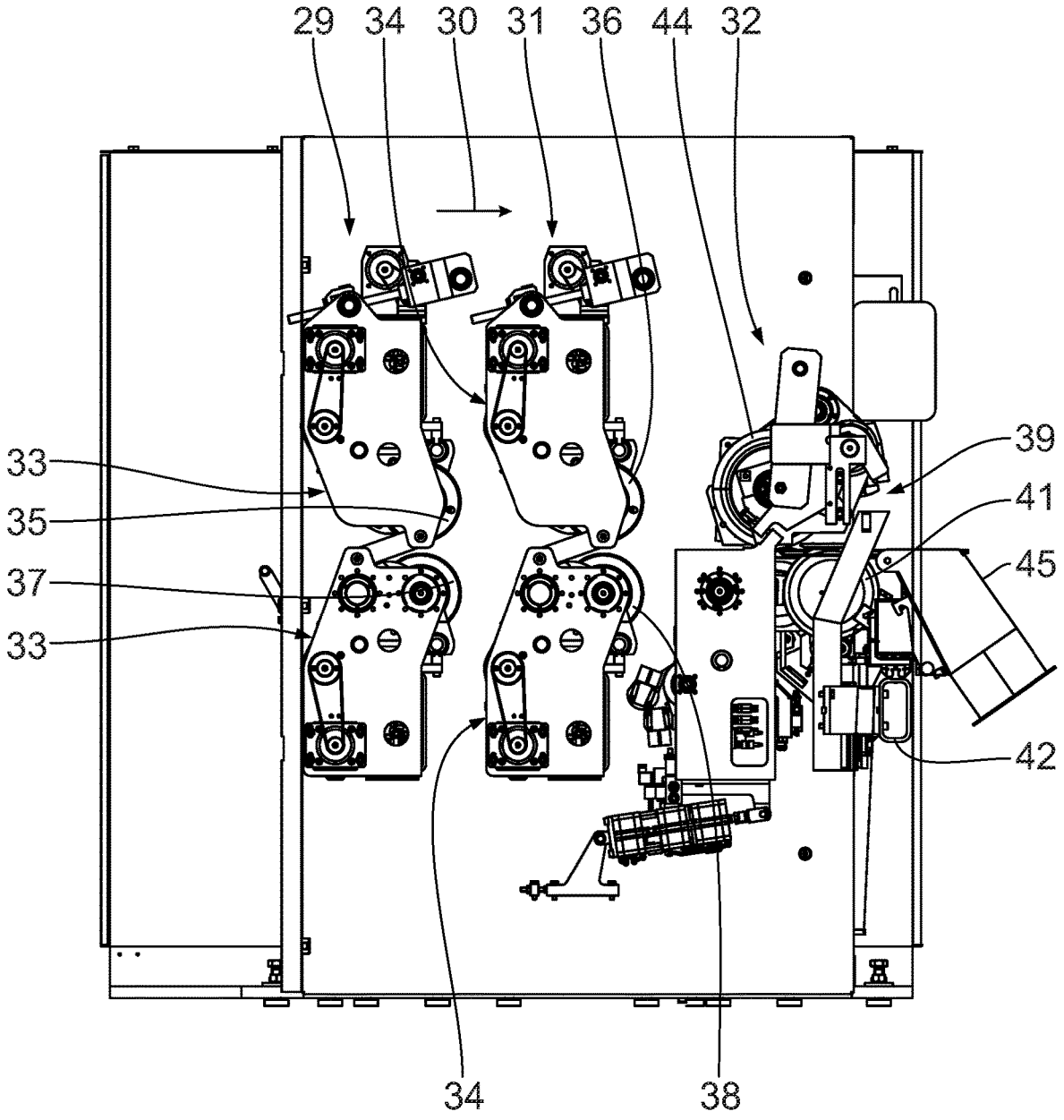
FIG. 3 shows a longitudinal sectional view of the longitudinal cutting/grooving device shown in FIG. 2 along section line III-III in FIG. 2.

Downstream of the short cross-cutting device 25, the corrugated board plant comprises a longitudinal cutting/grooving device 28, which is shown in a detailed view in FIGS. 2, 3. The longitudinal cutting/grooving device 28 has a first grooving unit 29 and a second grooving unit 31 arranged behind the former in the transport direction 30 of the double-face laminated web 2 of corrugated board. A longitudinal cutting device 32 of the longitudinal cutting/grooving device 28 is arranged downstream of the grooving devices 29, 31. A reverse arrangement of the grooving units 29, 31 and the longitudinal cutting device 32 is alternatively possible. Furthermore, it is conceivable to provide a second longitudinal cutting device.

The grooving units 29, 31 are advantageously identical. They each have two tool beds 33 or 34, respectively, which are arranged one above the other and substantially mirror-symmetrically to the double-face laminated web 2 of corrugated board.

The tool beds 33 of the first grooving unit 29 and the tool beds 34 of the second grooving unit 31 are in each case arranged one above the other in such a way as to form a respective pair, and are pivotable about horizontal pivot axes. Each upper tool bed 33, 34 is provided with grooving tools 35 or 36, respectively, which are arranged on tool holders and are displaceable transversely to the transport direction 30 of the double-face laminated web 2 of corrugated board.

The lower tool beds 33, 34 are provided with counterpart grooving tools 37 or 38, respectively, which are arranged on tool holders and are displaceable transversely to the transport direction 30 of the double-face laminated web 2 of corrugated board. The grooving tools 35 arranged on the upper tool bed 33 and the counterpart grooving tools 37 arranged on the lower tool bed 33 are in each case arranged in pairs. The grooving tools 36 arranged on the upper tool bed 34 and the counterpart grooving tools 38 arranged on the lower tool bed 34 are in each case arranged in pairs.

The grooving tools 35 and counterpart grooving tools 37 are adapted to be coupled to a threaded spindle separately to bring about a displacement of the corresponding tool 35, 37. In this manner, these tools are displaceable separately or together. The grooving tools 36 and counterpart grooving tools 38 are adapted to be coupled to a threaded spindle separately to bring about a displacement of the corresponding tool 36, 38. In this manner, these tools 36, 38 are displaceable separately or together.

The double-face laminated web 2 of corrugated board is guided through the first grooving unit 29 between the grooving tools 35 and counterpart grooving tools 37 associated thereto, and through the second grooving unit 31 between the grooving tools 36 and counterpart grooving tools 38 associated thereto.

The grooving tools 35 and counterpart grooving tools 37 of the first grooving unit 29 are configured to be brought into an engagement position or grooving position in which each pair of grooving tools 35 and counterpart grooving tools 37 produces a longitudinal grooving in the double-face laminated web 2 of corrugated board in the transport direction 30. They are also configured to be pivoted to a rest position in which the grooving tools and counterpart grooving tools 37 are disengaged from the double-face laminated web 2 of corrugated board. The above applies analogously to the second grooving unit 31. The grooving tools 35, 36 and counterpart grooving tools 37, 38 are each drivable for rotation. They are capable of producing longitudinal grooves in the double-face laminated web 2 of corrugated board.

The longitudinal cutting device 32 comprises at least one edge cutting unit 39 and at least one longitudinal cutting unit 40.

In particular, two edge cutting units 39 are provided in the region of longitudinal edges of the double-face laminated web 2 of corrugated board, which are associated to the double-face laminated web 2 of corrugated board. The edge cutting units 39 are preferably designed identically.

Each edge cutting unit 39 comprises a circular disc shaped cutting knife 41, which is drivable for rotation, and a counterpart member 44 associated thereto, the counterpart member 44 being configured as a brush or a table, for example. The double-face laminated web 2 of corrugated board is passed through between the cutting knives 41 and the counterpart members. Each edge cutting unit 30 is displaceable along a guide rail 42, which extends transversely to the transport direction 30 of the double-face web 2 of corrugated board. Each edge cutting unit 39 has a positioning motor for displacement along the guide rail 42.

Preferably, three longitudinal cutting units 40 are provided, which are preferably configured identically. Each longitudinal cutting unit 40 has a circular disc shaped cutting knife 43, which is drivable for rotation, and a counterpart member associated thereto, the counterpart member being configured as a brush or a table, for example. The double-face laminated web 2 of corrugated board is passed through between the cutting knives 43 and the counterpart members. The longitudinal cutting units 40 are displaceable along the guide rail 42. For this purpose, each longitudinal cutting unit 40 comprises a positioning motor for displacement in a direction transverse to the transport direction 30 of the double-face laminated web 2 of corrugated board.

The cutting knives 41, 43 are pivotable between a cutting position for cutting the double-face laminated web 2 of corrugated board in a longitudinal direction and a rest position. In the cutting position, the currently active cutting knife 41 or 43 penetrates the double-face laminated web 2 of corrugated board and engages the associated counterpart member 44. In the rest position, the cutting knives 41, 43 are disengaged from the double-face laminated web 2 of corrugated board.

The edge cutting units 39 allow endless edge strips to be cut off the double-face laminated web 2 of corrugated board, which are then discharged by edge strip discharge devices 45.

The longitudinal cutting units 40 allows the double-face laminated web 2 of corrugated board to be cut into endless partial webs, which are naturally laminated on both sides as well. In the regular cutting process, at least one longitudinal cutting unit 40 engages the double-face laminated web 2 of corrugated board, causing continuous longitudinal cuts to be produced, which causes partial webs to be formed having a predefined width.

Downstream of the longitudinal cutting/grooving device 28, the corrugated board plant has a switch 46 to distribute the partial webs produced from the double-face laminated web 2 of corrugated board among two planes.

Figure 4:
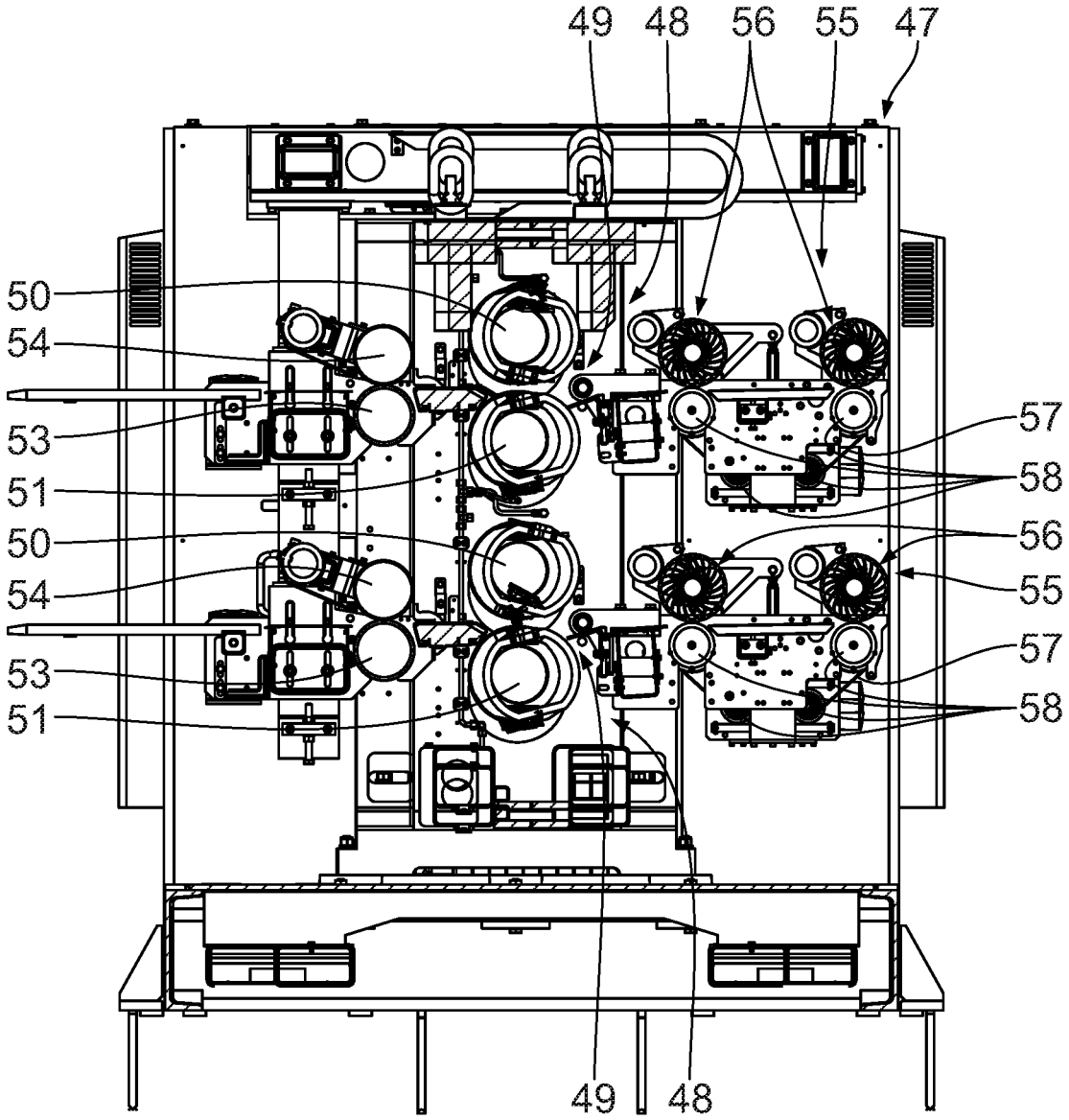
FIG. 4 shows a longitudinal sectional view of the cross cutting device of the corrugated board plant shown in FIG. 1.
Figure 5:
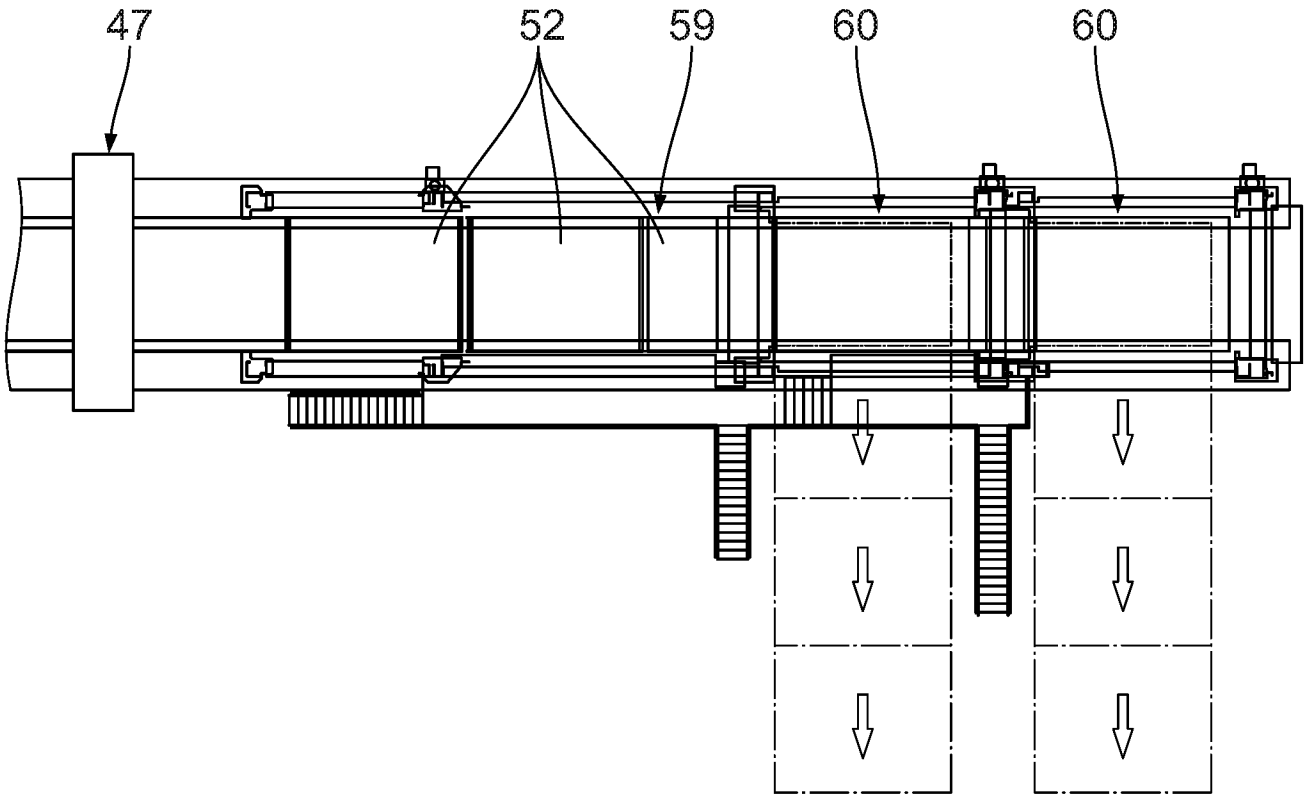
FIG. 5 shows a plan view of a downstream end section of the corrugated board plant shown in FIG. 1.
Figure 6:
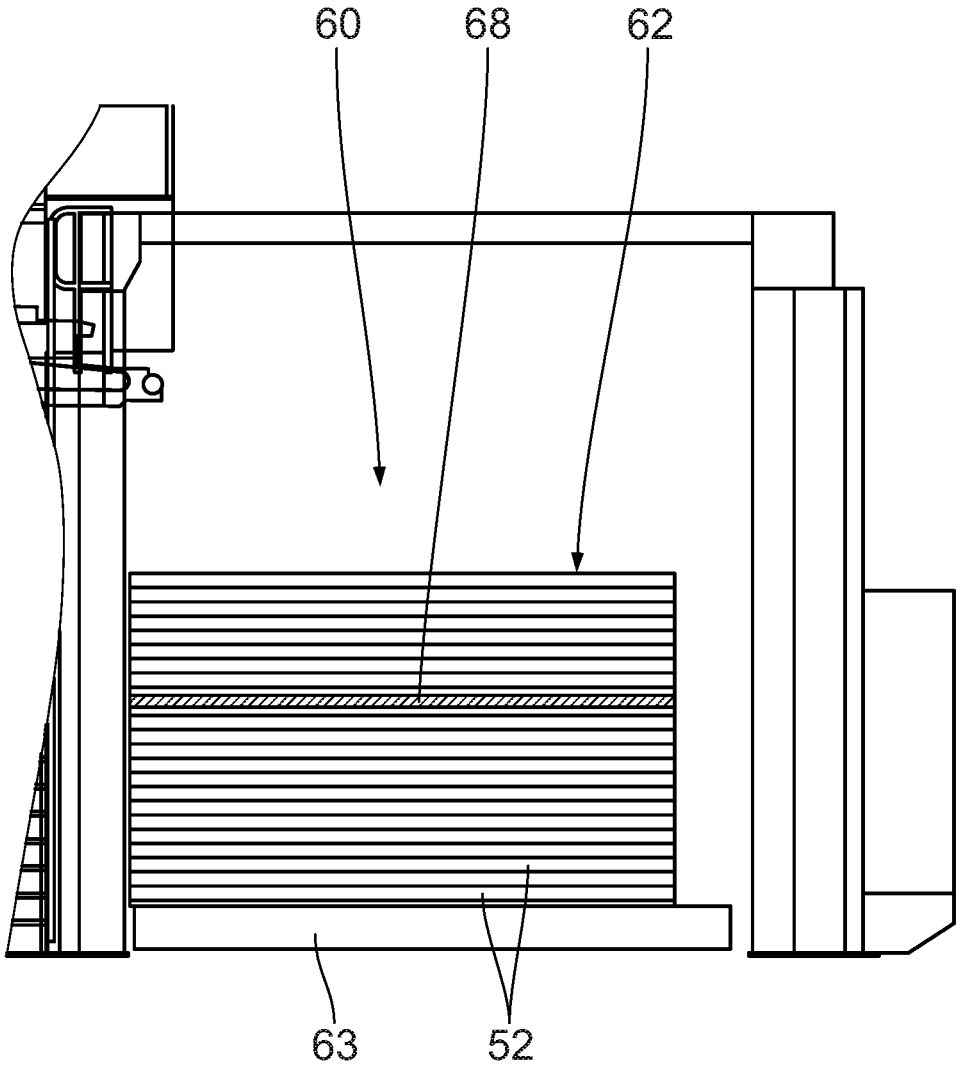
FIG. 6 shows a side view of a stack produced by the corrugated board plant shown in FIG. 1, the stack including an identification sheet.

Downstream of the switch 46, the corrugated board plant has a cross-cutting device 47 shown in a detailed view in FIG. 4, which comprises two cross-cutting units 48 arranged one above the other, the cross-cutting devices 48 advantageously being formed identically. A respective cross-cutting unit 48 is associated to each partial web to produce sheets from the respective partial web.

Each cross-cutting device 48 has a pair 49 of cross-cutting rollers, which comprises an upper cross-cutting roller 50, which is drivable for rotation about a first rotary axis, and a lower cross-cutting roller 51, which is drivable for rotation about a second rotary axis. The rotary axes are parallel to one another and perpendicular to the transport direction 30 of the double-face laminated web 2 of corrugated board or of the respective partial web.

Between the upper cross-cutting roller 50 and the lower cross-cutting roller 51 associated thereto, there is a respective roller gap through which the respective partial web is guided.

Each cross-cutting roller 50, 51 carries a knife (not shown), which extends radially outwardly and runs perpendicular to the transport direction 30 of the respective partial web. The knives of each pair 49 of cross-cutting rollers interact to cut the respective partial web in a transverse direction, thus allowing sheets 52 to be produced from the respective partial web. Cut sheets 52 are available downstream of the respective pair 49 of cross-cutting rollers.

A knife of a cross-cutting roller 50, 51 of a cross-cutting unit 48 is for example arranged in a spiral shape on the jacket surface thereof in such a way that an oblique position of the rotary axis in relation to the transport direction of the double-face laminated web 2 of corrugated board is compensated for in such a way that the double-face laminated web 2 of corrugated board can be cut along straight lines perpendicular to the transport direction 30. The oblique position of the rotary axis allows the double-face laminated web 2 of corrugated board to be cut progressively as the roller is revolving, thus allowing sheets 52 to be produced that have a predefined length.

Each cross-cutting unit 48 further has a feed roller 53 arranged upstream of the respective pair 49 of cross-cutting rollers, the feed roller 53 being rotatable or drivable for rotation about a rotary axis. The feed rollers 53 extend perpendicular to the respective partial web and are associated thereto. A counterpart feed roller 54 is arranged adjacent to each feed roller 53, the counterpart feed roller 54 forming a feed gap with the associated feed roller 53 to feed the respective partial web into the respective cross-cutting device 48.

Each cross-cutting unit 48 further has an outlet 55 with two outlet rollers 56, which are drivable for rotation, and a guide belt 57 associated thereto, the guide belt 57 being endless and guided around deflection rollers 58.

Each guide belt 57 is drivable and forms an outlet gap with the two outlet rollers 56 associated thereto through which the sheets 52 produced from the partial webs are advanced in the transport direction 30.

A sheet braking device 59 is arranged behind each cross-cutting unit 48, the sheet braking device 59 engaging the sheets 52 in a braking manner.

Advantageously, each sheet braking device 59 has a sheet guide unit and sheet braking means (not shown) associated thereto. The at least one sheet guide unit is for example configured as a table, belt, roller conveyor or the like. Each sheet 52 is guided on the respective sheet guide unit. In this manner, the sheets 52 are transportable in an overlapping manner, which allows them to be arranged in stacks more easily.

A stack depositing area 60 of the corrugated board plant is arranged downstream of each sheet braking device 59, said stack depositing area 60 having a vertical stop 61. Each stack depositing area 60 is capable of stacking the sheets 52 produced from the respective partial web to form a respective stack 62. Each stack depositing area 60 has a base 63, which carries the stack 62 and is height-adjustable to adapt the height of the stack 62 or to lower the stack 62 towards a machine base. In the lowered condition, the stacks 62 are movable away from the respective base 63 as a whole in a direction perpendicular to the transport direction 30.

As shown in FIG. 1, the longitudinal cutting/grooving device 28 is in signal connection with a central control unit 65 via a first signal line 64. In particular, each edge cutting unit 39 and each longitudinal cutting unit 40 are connected to the control unit 65. Furthermore, the cross-cutting device 45 is in signal connection with the control unit 65 via a second signal line 66. In particular, each cross-cutting device 48 is connected to the control unit 65. Furthermore, each stack depositing area 60 is in signal connection with the control unit 65 via a third signal line 67.

The corrugated board plant allows different stacks 62 to be produced. The sheets 52 stacked in the stacks 62 may differ from each other in terms of their geometry (such as width, height), design (such as number of layers, material) and/or imprint.

An identification sheet 68 is introduced in each stack 62, said identification sheet 68 differing from the remaining sheets 52 produced according to order in terms of its basic shape. The identification sheet 68 provides information as to the sheets 52 arranged in this stack 62, in particular in terms of its geometry, design and/or imprint.

The identification sheets 68 are produced by the corrugated board plant in an automatic or automated manner and are therefore located in each stack 62. They may be upper cover sheets, lower bottom sheets or intermediate sheets arranged in-between in the respective stack 62.

Figure 7:
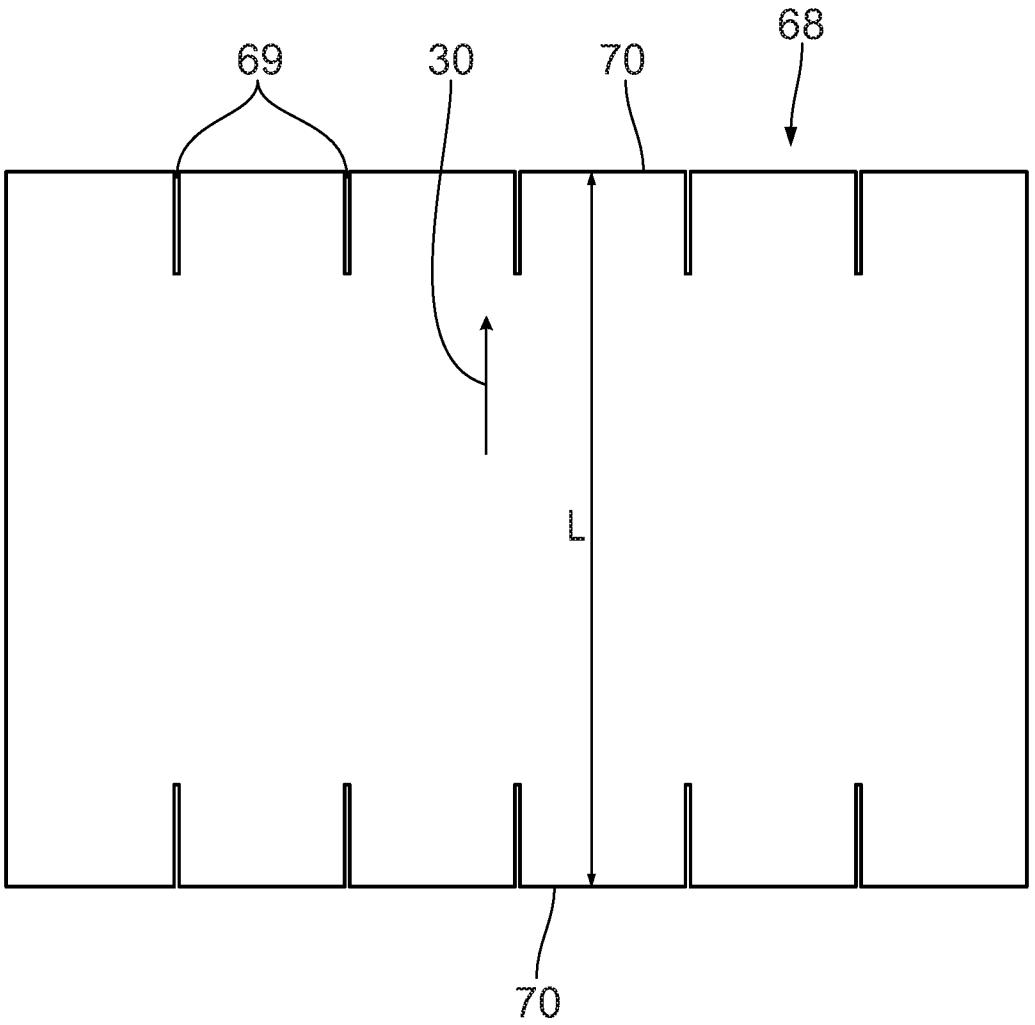
FIG. 7 shows a plan view of an identification sheet produced by the corrugated board plant according to FIG. 1, the identification sheet being shorter than the sheets produced according to order.

FIG. 7 shows an exemplary illustration of an identification sheet 68. Just like the sheets 52, the identification sheet 68 has markings 69 arranged adjacent to transverse edges 70 of the identification sheet 68. The markings 69 extend in the transport direction 30.

In this example, the identification sheet 68 has a uniform length L in the transport direction 30, said length L being shorter than the length of the other webs 52. The identification sheet 68 can be produced by the respective cross-cutting device 48. In particular, it can be produced by actuating the respective pair 49 of cross-cutting rollers accordingly. Compared to the production of the remaining sheets 52, the pair 49 of cross-cutting rollers is actuated with a reduced cut length or at an earlier point in time in order to produce an identification sheet 68 of this type. The difference in length between a sheet 52 and the identification sheet 68 is preferably between 30 mm and 100 mm.

Alternatively, the identification sheet 68 has a uniform length L in the transport direction 30, said length being greater than that of the sheets 52. The identification sheet 68 can be produced by the respective cross-cutting device 48. In particular, it can be produced by actuating the respective pair 49 of cross-cutting rollers accordingly. Compared to the production of the remaining sheets 52, the pair 49 of cross-cutting rollers is actuated with an increased cut length or at a later point in time in order to produce an identification sheet 68 of this type. The difference in length between a sheet 52 and the identification sheet 68 is preferably between 30 mm and 100 mm.

Alternatively, the identification sheet 68 has a uniform width perpendicular to the transport direction, which is greater or smaller than that of the sheets 52, which can be achieved by means of at least one respective edge cutting unit 39 and/or longitudinal cutting unit 40.

Figure 8:
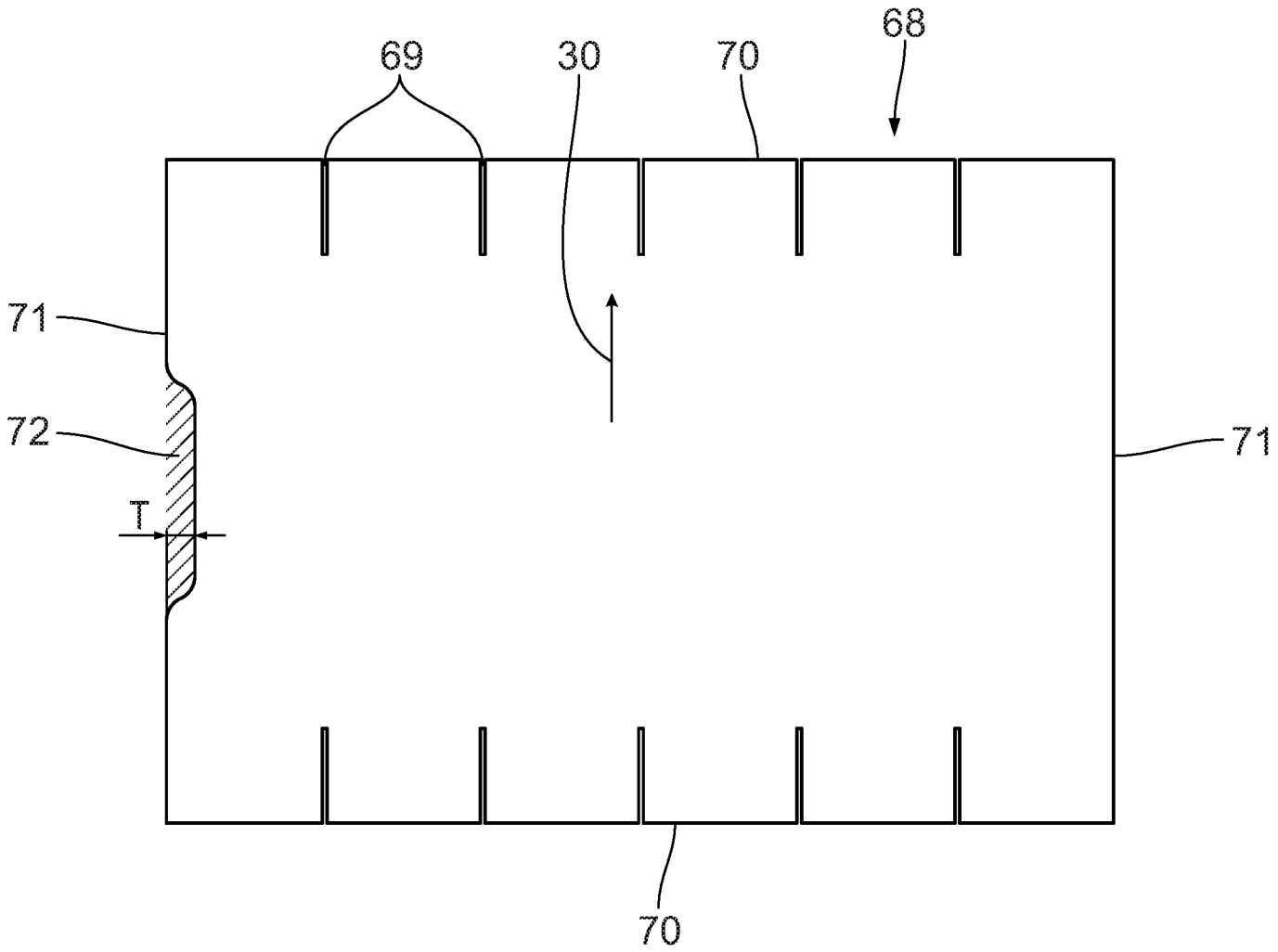
FIG. 8 shows a plan view of an identification sheet produced by the corrugated board plant according to FIG. 1, the identification sheet having an identification recess.

The identification sheet 68 shown in FIG. 8 has an identification recess 72 at a longitudinal edge 71 extending in the transport direction 30. The identification recess 72 is formed centrally in the longitudinal edge 71 and is open at the edge. It passes through the entire identification sheet 68 at the edge thereof. It has a depth T perpendicular to the transport direction 30, which is between 30 mm and 50 mm. The identification recess 72 can be produced, for example, by laterally displacing the edge cutting unit and/or the longitudinal cutting unit 40.

Figure 9:
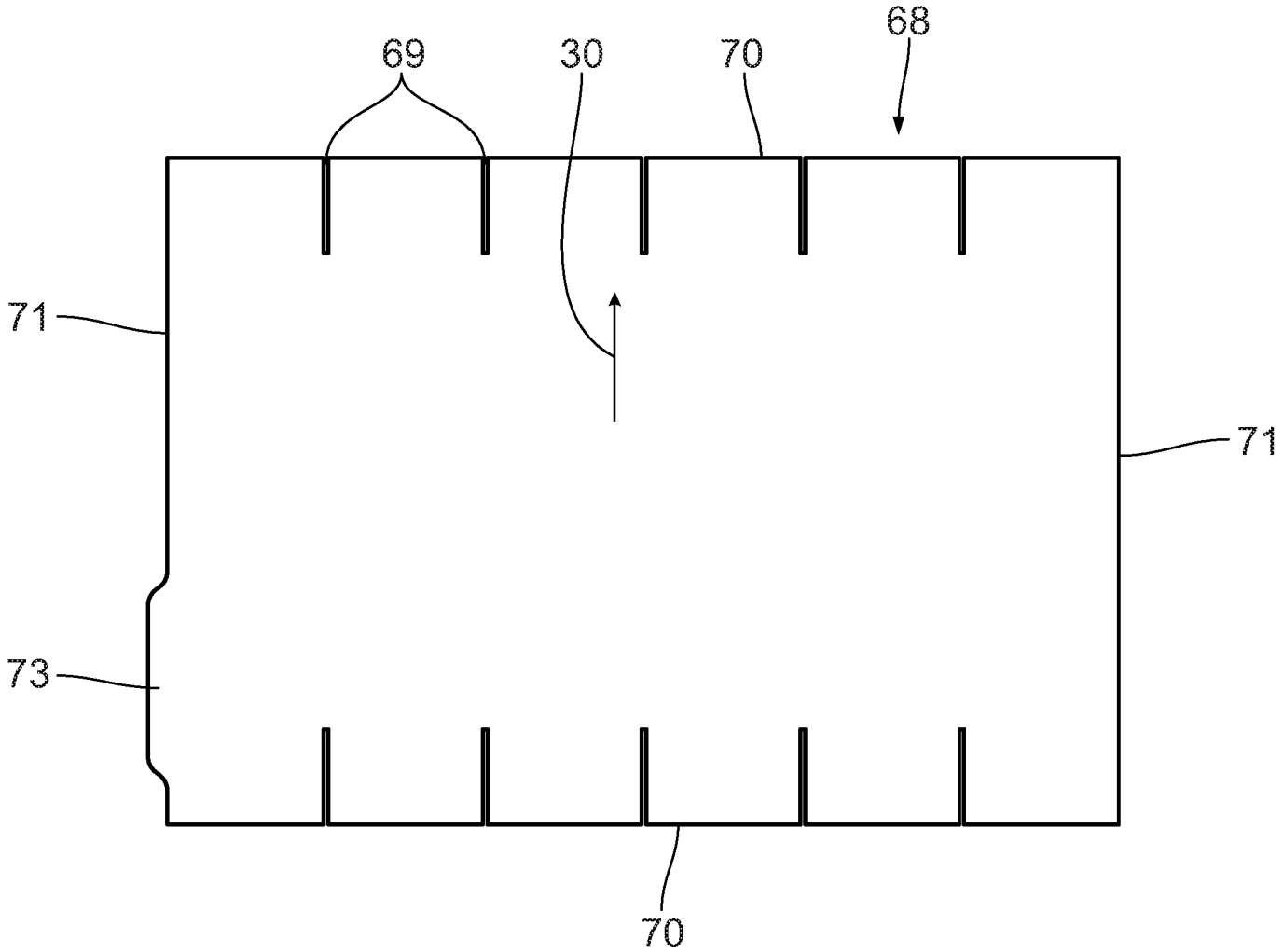
FIG. 9 shows a plan view of an identification sheet produced by the corrugated board plant according to FIG. 1, the identification sheet having an identification lug.

According to FIG. 9, the identification sheet 68 has an identification lug 73 at a longitudinal edge 71, said identification lug 73 being configured as an extension that is arranged in an off-center position. The identification lug 73 protrudes from the side by 5 mm to 20 mm. It can be produced by laterally displacing the respective edge cutting unit 39 and/or longitudinal cutting unit 40.

Alternatively, one of the longitudinal edges 70 is changed, which can be produced again by correspondingly displacing the edge cutting unit 39 and/or the longitudinal cutting unit 40.

The identification sheets 68 is easily visible by an operator, which allows this stack 62 or the sheets 52 received therein to be identified reliably. The stacks 62 can thus be found or distinguished from each other easily.

What is claimed is:

1. A method for producing corrugated board, the method comprising the steps of:

producing a double-face laminated web of corrugated board in a corrugated board production assembly;

producing sheets from the double-face laminated web of corrugated board by means of a cross-cutting device of a cutting assembly;

producing at least one identification sheet from the double-face laminated web of corrugated board by means of the cutting assembly, the at least one identification sheet differing from the sheets, wherein the cutting assembly comprises a longitudinal cutting/grooving device, which is capable of producing the at least one identification sheet; and stacking the sheets and the at least one identification sheet in a stack depositing area in such a way as to form a stack, which is identifiable by means of the at least one identification sheet.

2. The method as claimed in claim 1, wherein the at least one identification sheet allows the stack to be identified for further processing.

3. The method as claimed in claim 1, wherein the cross-cutting device is capable of producing the at least one identification sheet.

4. The method as claimed in claim 3, wherein the cross-cutting device has at least one cross-cutting member, which is actuable accordingly to produce the at least one identification sheet.

5. The method as claimed in claim 1, wherein the longitudinal cutting/grooving device has at least one cutting knife, which is actuable accordingly to produce the at least one identification sheet.

6. The method as claimed in claim 5, wherein the at least one cutting knife of the longitudinal cutting/grooving device moves laterally in a width direction of the at least identification sheet while the at least one identification sheet is being produced.

7. The method as claimed in claim 5, wherein the at least one cutting knife of the longitudinal cutting/grooving device changes its engagement depth with the double-face laminated web of corrugated board while the at least one identification sheet is being produced.

8. The method as claimed in claim 5, wherein the at least one cutting knife of the longitudinal cutting/grooving device is configured as an edge knife or longitudinal cutting knife.

9. The method as claimed in claim 1, wherein the at least one identification sheet is configured in such a way that the at least one identification sheet is visible from outside in the stack.

10. The method as claimed in claim 1, wherein the at least one identification sheet differs from the sheets in terms of its design.

11. The method as claimed in claim 1, wherein the at least one identification sheet differs from the sheets in terms of its length.

12. The method as claimed in claim 1, wherein the at least one identification sheet differs from the sheets in terms of its width.

13. The method as claimed in claim 1, wherein at least one edge of the at least one identification sheet differs from a corresponding edge of the sheets at least in sections.

14. The method as claimed in claim 1, wherein at least one longitudinal edge of the at least one identification sheet differs from a corresponding longitudinal edge of the sheets at least in sections.

15. The method as claimed in claim 14, wherein the at least one longitudinal edge of the at least one identification sheet differs from the corresponding longitudinal edge of the sheets by at least one of at least one identification recess and an identification lug.

16. The method as claimed in claim 1, wherein at least one transverse edge of the at least one identification sheet differs from a corresponding transverse edge of the sheets at least in sections.

17. The method as claimed in claim 1, wherein except for the at least one identification sheet disposed therein, the sheets arranged in a stack are identical.

* * * * *